US006953405B2

(12) United States Patent
LeMire et al.

(10) Patent No.: US 6,953,405 B2
(45) Date of Patent: Oct. 11, 2005

(54) VIBRATION DAMPING FIELD HOCKEY STICK

(75) Inventors: Laura E. LeMire, Catonsville, MD (US); Kenneth E. Sherman, Hampstead, MD (US)

(73) Assignee: STX, LLC, Baltimore, MD (US)

( * ) Notice: Subject to any disclaimer, the term of this patent is extended or adjusted under 35 U.S.C. 154(b) by 70 days.

(21) Appl. No.: 10/367,907

(22) Filed: Feb. 19, 2003

(65) Prior Publication Data

US 2003/0216197 A1 Nov. 20, 2003

Related U.S. Application Data

(60) Provisional application No. 60/357,143, filed on Feb. 19, 2002.

(51) Int. Cl.[7] ..... A63B 59/12
(52) U.S. Cl. ..... 473/520; 473/560
(58) Field of Search ..... 473/520, 560–563

(56) References Cited

U.S. PATENT DOCUMENTS

| | | | | |
|---|---|---|---|---|
| 3,649,163 | A | | 3/1972 | McCusker |
| 3,897,058 | A | | 7/1975 | Koch |
| 3,941,380 | A | * | 3/1976 | Lacoste ..... 473/520 |
| 3,971,559 | A | | 7/1976 | Diforte, Jr. |
| 4,105,205 | A | | 8/1978 | Theodores et al. |
| 4,108,436 | A | | 8/1978 | Masi |
| 4,130,619 | A | | 12/1978 | Held |
| 4,182,512 | A | | 1/1980 | Kuebler |
| 4,183,776 | A | | 1/1980 | Staub et al. |
| 4,238,262 | A | | 12/1980 | Fishel |
| 4,240,630 | A | | 12/1980 | Hoffman |
| 4,241,919 | A | | 12/1980 | Foreman |
| 4,251,073 | A | | 2/1981 | Birdsong, Jr. |
| 4,311,306 | A | | 1/1982 | Solloway |
| 4,337,283 | A | | 6/1982 | Haas, Jr. |
| 4,358,113 | A | * | 11/1982 | McKinnon et al. ..... 473/561 |
| 4,373,718 | A | | 2/1983 | Schmidt |
| RE31,811 | E | | 1/1985 | Foreman |
| 4,763,900 | A | | 8/1988 | Carr |
| 4,948,131 | A | | 8/1990 | Nakanishi |
| 4,984,792 | A | | 1/1991 | Pacanski |
| 5,088,732 | A | | 2/1992 | Kim |
| 5,180,163 | A | | 1/1993 | Lanctot et al. |
| 5,183,264 | A | * | 2/1993 | Lanctot ..... 473/520 |
| 5,193,246 | A | | 3/1993 | Huang |
| 5,197,732 | A | | 3/1993 | Lanctot |
| 5,380,003 | A | | 1/1995 | Lanctot |
| 5,417,418 | A | | 5/1995 | Terzaghi et al. |
| 5,452,889 | A | | 9/1995 | Lewinski et al. |
| 5,524,884 | A | * | 6/1996 | Haines ..... 473/521 |
| 5,551,082 | A | | 9/1996 | Stewart et al. |
| 5,590,875 | A | | 1/1997 | Young |

(Continued)

FOREIGN PATENT DOCUMENTS

| | | | |
|---|---|---|---|
| EP | 0 304 324 | | 2/1989 |
| EP | 0 519 312 | | 12/1992 |
| EP | 0 551 483 B1 | | 7/1993 |
| EP | 0 555 666 B1 | | 8/1993 |
| EP | 0 555 666 A1 | | 8/1993 |
| FR | 2610835 | * | 2/1987 |
| JP | 09-322950 | | 12/1997 |
| WO | WO 93/02753 | | 2/1993 |
| WO | WO 98/47574 | | 10/1998 |
| WO | WO 99/24749 | | 5/1999 |
| WO | PCT/US03/04502 | | 2/2003 |

*Primary Examiner*—Mark S. Graham
(74) *Attorney, Agent, or Firm*—Pillsbury Winthrop Shaw Pittman LLP

(57) ABSTRACT

A field hockey stick including a head, a shaft adjoining the head, and a vibration damper. The shaft has a first end proximate the head and a second end opposite the first end. The vibration damper is disposed in the second end of the shaft and includes a core and a jacket surrounding the core. The material of the core has a higher specific gravity than the material of the jacket.

32 Claims, 3 Drawing Sheets

U.S. PATENT DOCUMENTS 5,655,980 A 8/1997 Nashif et al.
5,772,540 A 6/1998 Kuebler
5,792,011 A 8/1998 Kuebler
5,964,672 A 10/1999 Bianchi
5,980,397 A 11/1999 Hart et al.
6,042,485 A * 3/2000 Cheng ..... 473/318
6,077,178 A 6/2000 Brandt
6,117,028 A 9/2000 You
6,203,455 B1 3/2001 Scherubl
6,241,633 B1 * 6/2001 Conroy ..... 473/561
6,354,958 B1 3/2002 Meyer
6,471,607 B2 10/2002 Hsu
6,625,848 B1 9/2003 Schneider

* cited by examiner

VIBRATION DAMPING FIELD HOCKEY STICK

This application claims the benefit of U.S. provisional patent application No. 60/357,143, filed Feb. 19, 2002, which is herein incorporated by reference in its entirety.

BACKGROUND

1. Field of the Invention

The present invention relates generally to field hockey sticks, and more particularly, to field hockey sticks having vibration damping characteristics.

2. Background of the Invention

In the game of field hockey, a field hockey stick is used to hit, push, or lift a hard ball that is usually made of a hard plastic, such as PVC. When the field hockey stick strikes the ball, a significant vibration occurs. Near the top of the handle of the stick, this vibration can generate a stinging or "buzz" in a player's hands. Although a grip on the handle of the stick can help lessen this sting, the vibration is still uncomfortable.

Field hockey sticks are typically made of a wood or composites. As used herein, composites refer to field hockey sticks made by wrapping sheets of uncured fiber-reinforced thermosetting resin around a mandrel, which is then withdrawn to form a hollow tubular layup. Examples of the materials used in the resin include fiberglass, carbon, and aramid. Composite sticks have been available on the market for over five years and have been approved for use in international play for over a year. Nonetheless, many players still prefer to use wood sticks because of a perceived better "feel" for the ball. This superior feel is partly attributable to the natural flexure and damping characteristics of wood. Compared to composite sticks, the traditional wood sticks are less stiff, thereby absorbing more vibration and affording a better feel for controlling the ball. Composite sticks, on the other hand, are generally stiffer and offer less feel because of increased vibration.

It is widely believed, however, that the increased stiffness of composite sticks offers an advantage over wood sticks in terms of power. Increased stiffness generates more powerful drives. Thus, with composite field hockey sticks, there is a tradeoff between increased power from stiffness and decreased feel from the vibration that the stiffness causes. Minimizing all or a sufficient portion of this vibration in a composite stick would therefore result in players delivering a powerful drive without experiencing more vibration than players have become accustomed to with wood field hockey sticks.

Therefore, field hockey sticks, especially those made of composite materials, would benefit greatly from a reduction in the vibration that can occur upon contact with a ball.

SUMMARY OF THE INVENTION

The present invention provides a field hockey stick that significantly reduces the vibrations that occur upon striking a ball. According to a preferred embodiment, the field hockey stick includes a shaft having a vibration damper disposed in its end opposite the head. The vibration damper includes a core and a jacket surrounding the core. The core material has a higher specific gravity (or density) than the jacket material. Preferably, the damper is placed within approximately the top six inches of the end of the field hockey stick handle, and more preferably, at the top of the handle.

In operation, the high density core oscillates within the jacket, and cancels out some or all of the vibration caused by the impact of the stick with a ball or other object. The jacket acts as a transfer agent, providing the appropriate medium needed to allow the core to vibrate. As a result, the vibrations of the field hockey stick diminish, allowing a player to, enjoy improved comfort and feel.

DETAILED DESCRIPTION OF THE INVENTION

According to an embodiment of the present invention, a field hockey stick is provisioned with a vibration damper. The vibration damper is composed of, for example, a high density core covered in a silicone "jacket." For maximum benefit, the damper is preferably placed within approximately the top six inches of the end of the field hockey stick shaft, corresponding to the location at which a player holds the stick. To fit the damper properly in the end of the stick, the damper is sized to fit securely in the handle without compressing or only slightly compressing the silicone. The high density core, preferably with a specific gravity in the range of approximately 7.0 to approximately 12.0, oscillates within the silicone, effectively canceling out or negating some or all of the vibration caused by the impact of the stick with a ball or other object. The silicone acts as a transfer agent, providing the appropriate medium needed to allow the core to vibrate.

Figure 1:
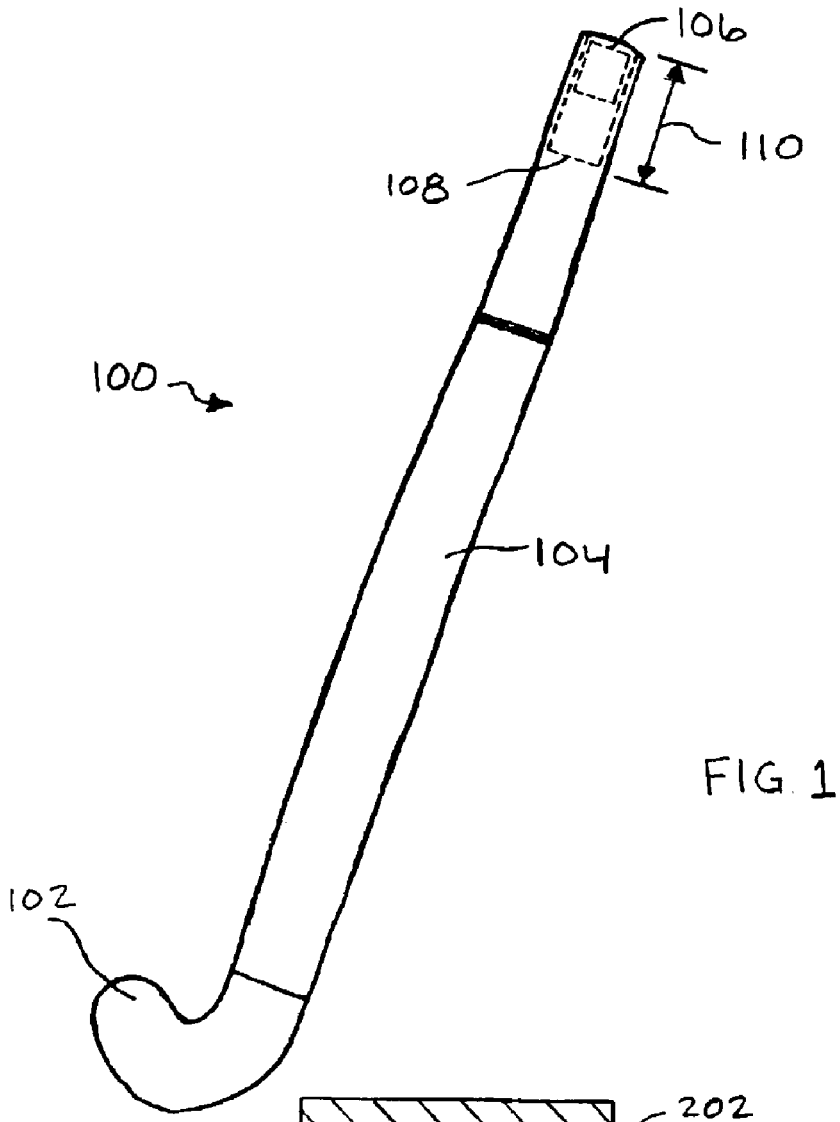
FIG. 1 is a schematic diagram of an exemplary vibration damping field hockey stick, according to an embodiment of the present invention.

FIG. 1 illustrates an exemplary vibration damping field hockey stick 100 of the present invention. Field hockey stick 100 includes a curved head or toe 102 and a shaft 104. Curved head 102 has a flat side (playing side) and a smooth rounded side (non-playing side). Shaft 104 can be of a uniform or variable cross-sectional area. A vibration damper 106 is disposed inside shaft 104 within a cavity 108. Vibration damper 106 is preferably positioned within approximately six inches of the end of shaft 104 opposite head 102, as represented by distance 110. In a preferred embodiment, vibration damper 106 is placed with its top at approximately the top end of shaft 104 (i.e., vibration damper 106 is adjacent to the end of shaft 104). In two other embodiments, vibration damper 106 is placed with its bottom at approximately three inches below the top end of shaft 104 and at approximately six inches below the top end of shaft 104.

Figure 2:
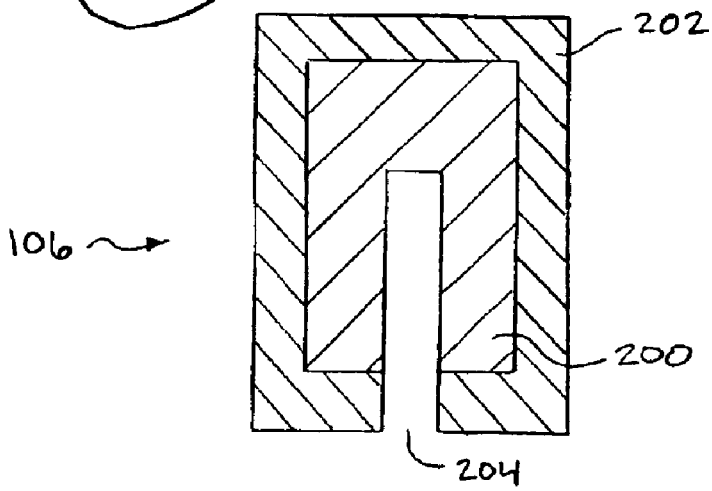
FIG. 2 is a schematic diagram of cross-sectional view of an exemplary vibration damper, according to an embodiment of the present invention.

FIG. 2 illustrates a cross-sectional view of a preferred embodiment of vibration damper 106. As shown, vibration damper 106 includes a core 200 enclosed by a jacket 202. Core 200 and jacket 202 are sized and shaped as appropriate to fit within cavity 108. The preferable size and shape therefore depend on the size and shape of the cross-section of shaft 104 in the area of cavity 108. In a preferred embodiment, however, core 200 and jacket 202 are generally cylindrical, which can accommodate a variety of shaft shapes (e.g., cylindrical, oval, or elliptical) and can simplify the methods by which vibration damper 106 is manufactured.

FIG. 2 also shows an optional center hole 204 disposed in both core 200 and jacket 202 of vibration damper 106. Center hole 204 is formed by a centering rod (not shown) that is used to manufacture vibration damper 106. In a preferred embodiment, a centering rod is used to ensure the correct positioning between core 200 and jacket. 202 and to help provide an even shape (e.g., cylindrical) and wall thickness for each. After core 200 is formed over the centering rod, and jacket 202 is formed over core 200 and the centering rod, the centering rod is removed, thereby leaving center hole 204. Of course, other manufacturing methods can be used to form vibration damper 106, which would not require a centering rod and would not result in center hole 204. For example, core 200 could be cast with a tail for centering core 200 within jacket 202.

To accommodate a typical field hockey stick, in a specific implementation of vibration damper 106, core 200 is substantially cylindrical, with a diameter of approximately 12 mm and a length of approximately 20.4 mm. Jacket 202 is also substantially cylindrical, with a diameter of approximately 19 mm and a length of approximately 27 mm.

To provide the desired vibration damping, core 200 preferably has a higher specific gravity than jacket 202. In a specific implementation, core 200 weighs approximately 22.5 g and jacket 202 weighs approximately 6.2 g, making the weight of vibration damper 106 approximately 28.7 g. In a preferred embodiment, jacket 202 is made of silicone having a specific gravity of approximately 1.1 and core 200 is made of a plastic composite, such as Thermocomp™ HSG-P-1000A, produced by LNP Engineering Plastics Inc. of Exton, Pa. Thermocomp™ HSG-P1000 A has a specific gravity of approximately 10.0 and a Rockwell hardness (M scale) of approximately 80.0. Alternatively, core 200 could be made of any material or combination of materials having a specific gravity of approximately 7.0 to approximately 12.0, such as metal, metal composites, plastic-metal composites, plastics, and plastic composites. Likewise, as an alternative to silicone, jacket 202 could be made of any material or combination of materials having an appropriate specific gravity, such as rubber, foam, and thermoplastics. In some instances, these material options may be precluded by the game rules of certain field hockey governing bodies.

Figure 3:
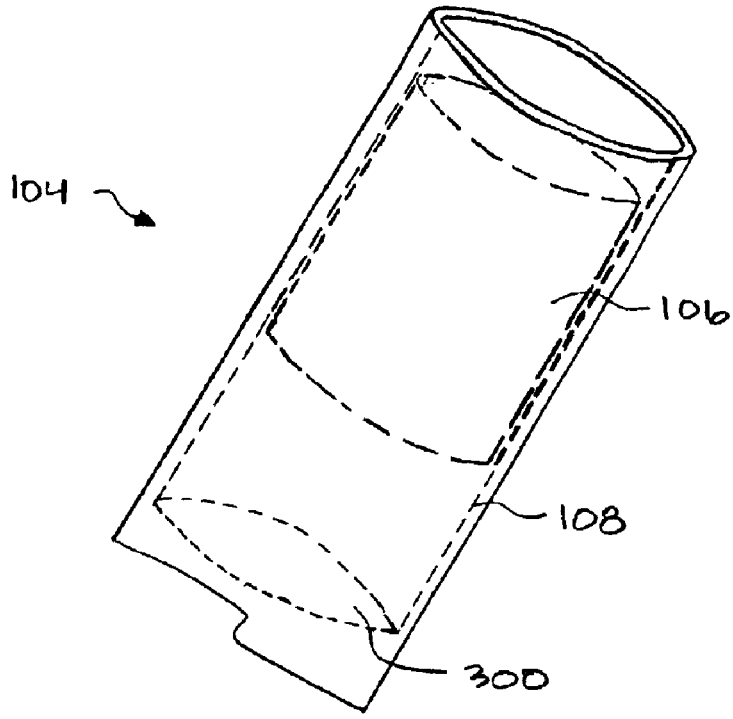
FIG. 3 is a schematic diagram of an exemplary solid field hockey stick shaft for receiving a vibration damper, according to an embodiment of the present invention.

As shown generally in FIG. 1, vibration damper 106 is disposed within cavity 108 of shaft 104. Preferably, however, as shown in FIG. 3, vibration damper 106 fits snugly within cavity 108 so that vibrations through field hockey stick 100 are transmitted directly to vibration damper 106. Thus, vibration damper 106 is preferably sized equal to or slightly larger than cavity 108, and jacket 202 is at least partially compressible. In this manner, vibration damper 106 can be pushed into cavity 108 and held firmly in place by the interference fit. In this position, the compressible jacket 202 helps maximize the contact area between vibration damper 106 and the wall of cavity 108.

Figure 4:
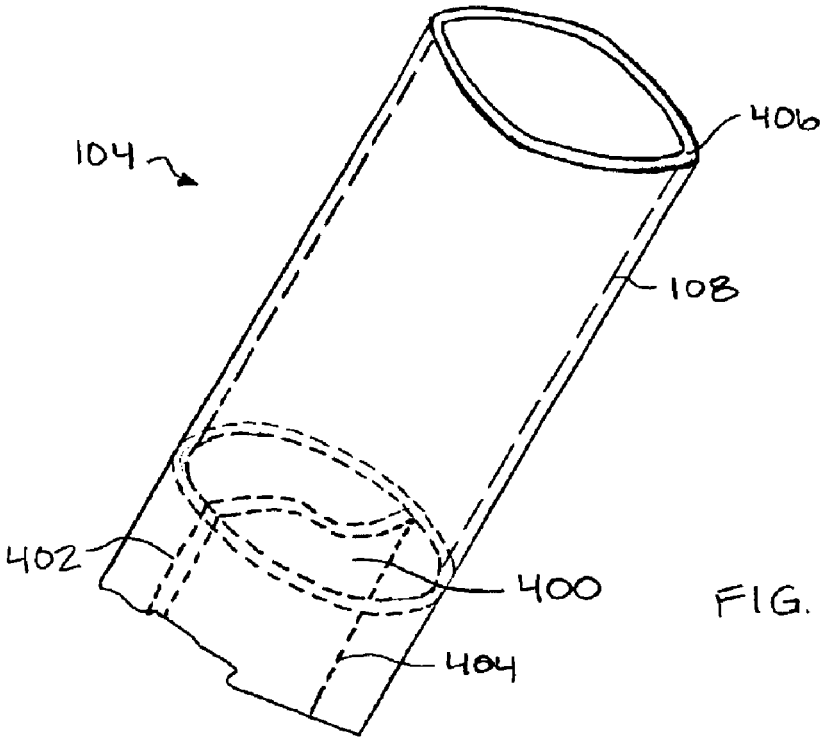
FIG. 4 is a schematic diagram of an exemplary hollow field hockey stick shaft for receiving a vibration damper, according to an embodiment of the present invention.

In addition to the interference fit provided by compressible jacket 202, a further embodiment of the present invention supports vibration damper 106 with the interior structure of shaft 104 that is adjacent to cavity 108. In the case of a solid shaft 104, such as with a wood field hockey stick, vibration damper 106 can be pushed to the bottom of cavity 108 so that vibration damper 106 rests on the solid center 300 of the shaft 104 shown in FIG. 3. In the case of a composite shaft, as shown in FIG. 4, the interior structure of shaft 104 is typically hollow with a structural rib 400 attached to the outer wall of the shaft 104 along at least two axial lines 402 and 404 of the outer wall. This rib 400 stops short of the end 406 of shaft 104 to provide the cavity 108 in which to position damper 106. The remaining length of rib 400 preferably remains intact to maintain the structural integrity of the field hockey stick. Vibration damper 106 can be disposed in cavity 108 above rib 400 by an interference fit, without contacting rib 400. Alternatively, vibration damper 106 can rest on rib 400 for additional support.

In a further embodiment of the present invention, vibration damper 106 is held in place within cavity 108 using an adhesive between jacket 202 and the wall of cavity 108. In another embodiment, a mechanical fastener holds vibration damper 106 in place within cavity 108. In another embodiment, vibration damper 106 rests on another material placed within cavity 108. For example, vibration damper 106 could rest on a foam plug disposed in the bottom of cavity 108. In another embodiment, in the case of completely hollow shaft (e.g., without a rib), a foam plug could be inserted into the hollow shaft to create the bottom of cavity 108.

Thus, the vibration damping field hockey stick of the present invention provides a player with improved comfort, feel, and playability. In addition, when applied to a composite stick, the present invention minimizes the discomfort from vibration associated with increased power. To maximize these benefits, the core 200 and jacket 202 of vibration damper 106 are sized, configured, and constructed from materials best suited for a particular field hockey stick, based on, for example, the size, weight, geometry, and material of the stick. Preferably, the vibration damper has a natural vibrational frequency equal to the natural vibrational frequency of the particular stick. Achieving these equivalent frequencies involves varying, for example, the size, shape, mass, and material of the core 200 and jacket 202 of vibration damper 106.

Figure 5:
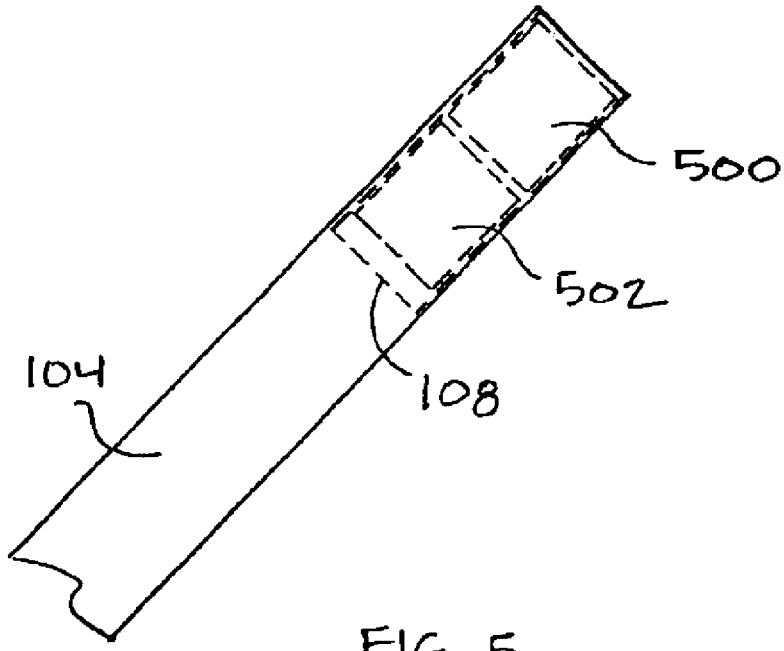
FIG. 5 is a schematic diagram of an exemplary vibration damping field hockey stick having multiple vibration dampers, according to an embodiment of the present invention.
Figure 6:
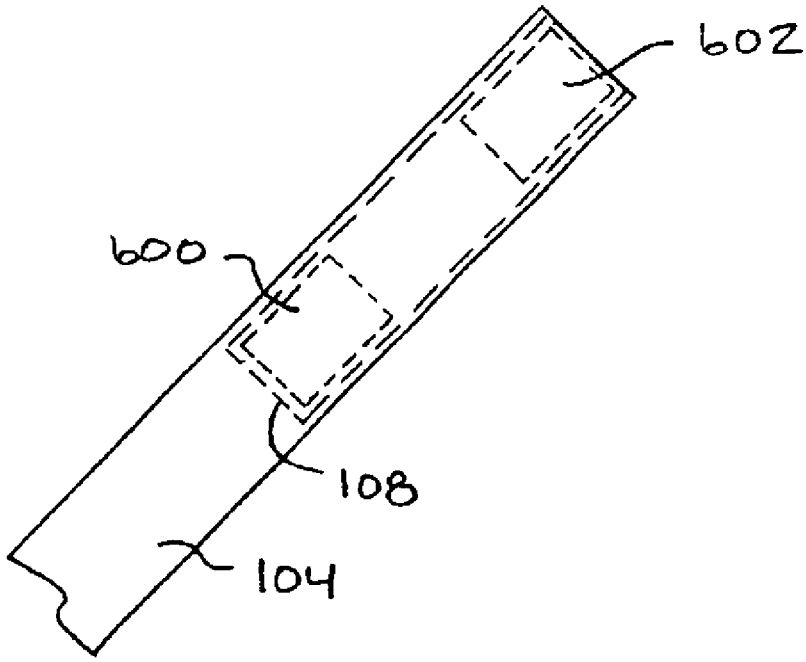
FIG. 6 is a schematic diagram of an exemplary vibration damping field hockey stick having two vibration dampers spaced apart, according to an embodiment of the present invention.

Referring again to FIG. 1, an alternative embodiment of the present invention provides multiple vibration dampers for vibration damper 106. An example of this embodiment stacks two dampers 500 and 502 within cavity 108 as shown in FIG. 5. Of course, any number of dampers can be used, as appropriate to fit within cavity 108. In addition, the multiple vibration dampers can be disposed within cavity 108 in the various positions described above for the single vibration damper embodiment. For example, two vibration dampers can be stacked with the bottom of the lower vibration damper at approximately three or six inches from the top of shaft 104. As another example, two vibration dampers can be stacked with the top of the upper vibration damper at approximately the top of shaft 104. In a further embodiment, multiple vibration dampers are positioned within cavity 108 with spaces in between each damper. For example, as shown in FIG. 6, the bottom of a lower damper 600 could be at approximately six inches from the top of shaft 104 and the top of an upper vibration damper 602 could be at approximately the top of shaft 104. As one of ordinary skill in the art would appreciate, the positioning and number of dampers can vary as necessary to maximize the vibration damping of a particular field hockey stick.

Tests conducted on an exemplary vibration damping field hockey stick of the present invention have shown improvements in vibrational performance in comparison to traditional undamped field hockey sticks. Specifically, the present invention provides a significant reduction in the high-frequency vibration of the field hockey stick shaft that results upon striking a ball and contributes to user discomfort. In addition, time histories of vibration following excitation have confirmed the effectiveness of the vibration damper in reducing the overall level and duration of vibration.

In the experiments, a field hockey stick was suspended vertically between two relatively rigid vertical steel supports with a piece of piano wire about six inches from the top of the shaft. An accelerometer (Crossbow±4 g model) was attached below the top of the shaft and connected, through appropriate electronics, to an Ono Sokki™ spectrum analyzer that was used for the data acquisition.

The field hockey stick was tested first without the damper, and then with the damper wedged snugly into the top of the shaft. Additional tests were performed with the bottom of the vibration damper at approximately three and six inches from the top of the shaft. In addition, tests were performed with two vibration dampers disposed in the shaft in the three different positions: at approximately the top of the shaft, at approximately three inches from the top of the shaft, and at approximately six inches from the top of the shaft.

Frequency spectra for these tests were recorded to the analyzer. Frequency spectra (which show the distribution of vibration energy across a structure's vibrational mode frequency range) were generated by repeatedly hitting the stick with a small hard-rubber-headed hammer for a period of about 30 seconds. This test was repeated twice over each of the frequency ranges investigated (0–500 Hz, 0–100 Hz, 0–50 Hz) to check for consistency. Time histories were also recorded, showing the transient response of the stick to being struck by the hammer.

In a first series of tests, an undamped field hockey stick exhibited a countable set of frequencies at which it responded. Vibration peaks were evident at the following frequencies: 5 Hz, 56 Hz, 109 Hz, 156 Hz, 211 Hz, 221 Hz, 276 Hz, 324 Hz, 428 Hz, 439 Hz, and 491 Hz. The most significant response was at 109 Hz.

In a corresponding damped stick with a damper wedged snugly into the top of the shaft, the vibration peaks occurred at 5 Hz, 109 Hz, and 276 Hz, with the vibrations at the other frequencies (of the undamped stick) largely suppressed. The peak at 109 Hz was shifted more to the left, and was closer in magnitude to the undamped spectral peaks, which is presumably consistent with a lowering of that peak due to the addition of the mass.

In a second series of tests, an undamped field hockey stick exhibited significant vibration at frequencies of around 118 Hz and 331 Hz. The vibration amplitude peaks at these frequencies are responsible for the uncomfortable "buzz" typically felt by players using field hockey sticks, especially composite sticks.

In contrast, corresponding damped sticks constructed according to different embodiments of the present invention significantly suppressed the vibration amplitude peaks at the 118 Hz and 331 Hz frequencies. In the case of a single damper, reduction of the vibration amplitude peaks at the 118 Hz and 331 Hz frequencies was most effectively achieved with the vibration damper positioned at the top location. The locations at three inches and six inches from the top of the shaft were progressively less effective in suppressing the vibration amplitude peaks at the 118 Hz and 331 Hz frequencies, but still provided beneficial damping over the undamped stick.

In the case of two vibration dampers, reduction of vibration amplitude peak at 118 Hz was effectively achieved with the dampers at all locations. For 331 Hz, the top location best suppressed the peak, with the locations at three inches and six inches from the top of the shaft less effective, but still providing benefits over the undamped stick.

Comparing the one damper embodiment to the two damper embodiment, the tests showed that, at the three inch location, two dampers appear more effective than one in suppressing the vibration amplitude peak at the 118 Hz frequency. At the top location, the tests showed that one damper appears slightly more effective than two dampers in suppressing the vibration amplitude peak at 118 Hz.

Thus, the experiments showed that, by suppressing vibration amplitude peaks at certain frequencies, the vibration damping field hockey stick of the present invention improves performance. Suppressing these peaks minimizes the uncomfortable "buzz" of a field hockey stick. The level of this "buzz" is a principal determining factor in a stick's acceptability among players.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A field hockey stick comprising;

a head;

a shaft adjoining the head, wherein the shaft has a first end proximate the head and a second end opposite the first end, and wherein the second end of the shaft defines a cavity; and a vibration damper disposed within the shaft proximate the second end and disposed in the cavity, wherein the vibration damper comprises a core and a jacket surrounding the core, wherein the core is made of a core material and the jacket is made of a jacket material, and wherein the core material has a higher specific gravity than the jacket material, wherein the shaft has an interior structure on a side of the cavity opposite the second end, and wherein the interior structure supports the vibration damper, wherein the shaft comprises an outer wall and an interior rib, wherein the interior rib stops short of the second end, and wherein the vibration damper rests on the interior rib, and wherein the interior structure is the interior rib.

2. The field hockey stick of claim 1, wherein the head and the shaft are made of one of a wood material, a composite, and a combination thereof.

3. The field hockey stick of claim 1, wherein the interior rib is attached to the outer wall along at least two axial lines of the outer wall.

4. The field hockey stick of claim 1, wherein the vibration damper is within approximately six inches from the second end.

5. The field hockey stick of claim 1, wherein the shaft is a composite shaft.

6. The field hockey stick of claim 1, wherein the core material has a specific gravity within a range of approximately 7.0 to approximately 12.0.

7. The field hockey stick of claim 6, wherein the core material is a plastic composite.

8. The field hockey stick of claim 1, wherein the core material has a Rockwell hardness of approximately 80.0 M-scale.

9. The field hockey stick of claim 1, wherein the jacket material has a specific gravity of approximately 1.1.

10. The field hockey stick of claim 1, wherein the jacket material is one of rubber, thermoplastic, silicone, and a combination thereof.

11. The field hockey stick of claim 1, wherein the vibration damper has a top face and a bottom face, and wherein the top face is adjacent to the second end.

12. The field hockey stick of claim 1, wherein the vibration damper has a top face and a bottom face, and wherein the bottom face is disposed approximately three inches from the second end.

13. The field hockey stick of claim 1, wherein the vibration damper has a top face and a bottom face, and wherein the top face is disposed approximately six inches from the second end.

14. The field hockey stick of claim 1, wherein the field hockey stick, when struck, produces vibrations at approximately 118 Hz and approximately 331 Hz that are less than corresponding vibrations in the field hockey stick, when struck, with the vibration damper removed.

15. A field hockey stick comprising:

a head;

a shaft adjoining the head, the shaft having a first end proximate the head and a second end opposite the first end; and a vibration damper disposed within the shaft proximate the second end, wherein the vibration damper has a top face and a bottom face, wherein the top face is adjacent to the second end, and wherein the vibration damper comprises:

a core made of a core material having a specific gravity within a range of
approximately 7.0 to approximately 12.0, and a jacket surrounding the core, wherein the jacket is made of a jacket material, and
wherein the core material has a higher specific gravity than the jacket material, and wherein the shaft comprises an outer wall and an interior rib, wherein the interior rib stops short of the second end, and wherein the vibration damper rests on the interior rib.

16. The field hockey stick of claim 15, wherein the core and the jacket are substantially cylindrical.

17. The field hockey stick of claim 16, wherein the core is approximately 12 mm in diameter and approximately 20.4 mm in length, and wherein the jacket is approximately 19 mm in diameter and approximately 27 mm in length.

18. The field hockey stick of claim 15, wherein the core weighs approximately 22.5 g and the jacket weighs approximately 6.2 g.

19. The field hockey stick of claim 15, wherein the jacket material is silicone.

20. The field hockey stick of claim 15, wherein the jacket material has a specific gravity of approximately 1.1.

21. The field hockey stick of claim 15, wherein the core material has a Rockwell hardness of approximately 80.0 M-scale.

22. The field hockey stick of claim 15, wherein the core material is a plastic composite having a specific gravity of approximately 10.0.

23. The field hockey stick of claim 15, wherein the vibration damper is adapted to suppress vibrations of the field hockey stick at frequencies of approximately 118 Hz and approximately 331 Hz.

24. A field hockey stick comprising:

a head;

a shaft adjoining the head, wherein the shaft has a first end proximate the head and a second end opposite the first end; and a vibration damper disposed within the shaft proximate the second end, wherein the vibration damper comprises a core and a jacket surrounding the core, wherein the core is made of a core material and the jacket is made of a jacket material, and wherein the core material has a higher specific gravity than the jacket material, and wherein the shaft comprises an outer wall and an interior rib, wherein the interior rib stops short of the second end, and wherein the vibration damper rests on the interior rib.

25. The field hockey stick of claim 24, wherein the vibration damper is disposed adjacent to the second end.

26. The field hockey stick of claim 24, wherein the core material has a specific gravity within a range of approximately 7.0 to approximately 12.0.

27. The field hockey stick of claim 26, wherein the core material is a plastic composite.

28. The field hockey stick of claim 26, wherein the jacket material has a specific gravity approximately 1.1.

29. The field hockey stick of claim 28, wherein the jacket material is silicone.

30. The field hockey stick of claim 24, wherein the field hockey stick, when struck, produces vibrations at approximately 118 Hz and approximately 331 Hz that are less than corresponding vibrations in the field hockey stick, when struck, with the vibration damper removed.

31. The field hockey stick of claim 24, wherein the interior rib is attached to the outer wall along at least two axial lines.

32. The field hockey stick of claim 24, wherein the jacket is compressed by the outer wall to further secure the vibration damper within the shaft.

* * * * *